US007073457B2

(12) United States Patent
Boatman

(10) Patent No.: US 7,073,457 B2
(45) Date of Patent: Jul. 11, 2006

(54) DUPLEX YOKE MOORING SYSTEM

(75) Inventor: L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/636,994

(22) Filed: Aug. 6, 2003

(65) Prior Publication Data

US 2004/0025772 A1 Feb. 12, 2004

Related U.S. Application Data

(60) Provisional application No. 60/408,274, filed on Sep. 6, 2002, provisional application No. 60/401,478, filed on Aug. 6, 2002.

(51) Int. Cl.
*E02B 3/24* (2006.01)

(52) U.S. Cl. ..... 114/230.15; 441/5; 141/387

(58) Field of Classification Search ..... 114/230.1, 114/230.13–230.19; 441/3–5; 141/387; 212/307

See application file for complete search history.

(56) References Cited

U.S. PATENT DOCUMENTS

| | | | | |
|---|---|---|---|---|
| 3,778,854 | A | 12/1973 | Chow | |
| 4,007,599 | A | 2/1977 | Brown | |
| 4,352,596 | A | 10/1982 | Hammett | |
| 4,393,906 | A * | 7/1983 | Gill | 141/387 |
| 4,494,475 | A | 1/1985 | Eriksen | |
| 4,530,302 | A | 7/1985 | Pedersen | |
| 4,568,295 | A | 2/1986 | Poldervaart | |
| 4,606,294 | A | 8/1986 | Di Tella et al. | |
| 4,665,856 | A | 5/1987 | Pedersen | |
| 4,735,167 | A | 4/1988 | White et al. | |
| 6,227,135 | B1 | 5/2001 | Pedersen | |
| 6,244,920 | B1 | 6/2001 | de Baan | |
| 6,609,544 | B1 | 8/2003 | Williamson | |

FOREIGN PATENT DOCUMENTS

| | | |
|---|---|---|
| EP | 0947464 | 10/1999 |
| GB | 2383317 A | 12/2001 |
| WO | WO 03/049994 A1 | 6/2003 |

* cited by examiner

*Primary Examiner*—Jesus D. Sotelo
(74) *Attorney, Agent, or Firm*—Gary L. Bush, Esq.; Andrews Kurth LLP

(57) ABSTRACT

An offshore offloading system for hydrocarbon products from a storage station such as an LNG/FPSO to a shuttle vessel. The system includes a yoke mooring arrangement having a yoke and a connection assembly. One end of the yoke is selectively disconnectable to the shuttle vessel, while the other end of the yoke is rotatably connected to an end of the connection assembly which has its other end rotatably connected to a frame which extends from an end of the storage station. The yoke and connection assembly are arranged such that a transverse force in the lateral or y-direction moves the end of the yoke less than twice the movement of the yoke in response to an x-direction force. The system also includes arrangements for providing a hydrocarbon fluid flow path from the storage station to the shuttle vessel when the shuttle vessel is disconnectably moored to the storage station. A first fluid flow path arrangement includes a crane/boom arrangement mounted on a frame extension of the storage station so that a crane slewing arc radius of the transfer system is not larger than one half the separation distance between the storage station and a forward perpendicular of the shuttle vessel. A second arrangement includes a fixed frame with a piping pantograph mount at its end. A trolley and service platform suspended therefrom move between an operational position away from the pantograph and a service position beneath the pantograph when it is folded into a storage position.

11 Claims, 12 Drawing Sheets

$$K_x = \frac{\Delta F_x}{\Delta x1} \qquad K_y = \frac{\Delta F_y}{\Delta y1}$$

DUPLEX YOKE MOORING SYSTEM

CROSS REFERENCE TO RELATED APPLICATIONS

This application claims priority from Provisional Application 60/408,274 filed on Sep. 6, 2002 and Provisional Application 60/401,478 filed on Aug. 6, 2002.

BACKGROUND OF THE INVENTION

1) Field of the Invention

This invention relates generally to mooring and fluid transfer systems and in particular to Floating Production Storage and Offloading vessels (FPSO's) including those for LNG liquefaction production and storage. More particularly, this invention relates to tandem offloading of a permanently moored LNG liquefaction and storage vessel to a shuttle or LNG carrier vessel. The term "tandem offloading" describes an arrangement where the shuttle vessel is behind and generally inline with the FPSO, as opposed to "side-by-side offloading" where the LNG carrier is moored along side the FPSO in a parallel position.

2) Description of the Prior Art

Periodically LNG carrier vessels arrive at the location of an LNG/FPSO to load liquefied gas for transport to distant ports. The term LNG is an acronym for Liquified Natural Gas. Highly reliable and safe temporary mooring equipment is required to mechanically connect the LNG carrier (LNGC) to the stem of the LNG/FPSO in offshore sea conditions while LNG transfer occurs between the two vessels.

FIGS. 1 and 2 illustrate a prior art LNG transfer system, such as the FMC Technologies BTT system, with piping and flexible joint swivels connecting the FPSO vessel 1 to LNG carrier vessel 2. Hawser 8 endures the mooring force to hold vessel 2 to the stern of FPSO vessel 1. Disadvantages of the hawser mooring system include the lack of restraint to prevent vessel 2 from surging forward and colliding with FPSO vessel 1. In addition, hawser 8 allows a wide range of lateral motion of vessel 2, as indicated by motion arrows L. Piping pantograph 5 is flexible and allows limited horizontal motion of LNG manifold connector 7, such as within a circle of 12 meters radius. As vessel 2 sways laterally, crane boom 4 mounted on pedestal 34, must rotate automatically to follow the wide excursions of LNGC 2 bow B while connected to manifold 7 on LNGC 2.

FIGS. 1 and 2 illustrate that because of the wide lateral movement of the LNGC 2 with respect to the end of the FPSO 1, a crane pedestal 34 with a rotatable boom 4 is required, because the pantograph 5 with a manifold connector 6 is capable of only a limited lateral movement L. It would be desirable to eliminate the crane pedestal 34 and rotatable boom 4 in favor of a fixed structure where a mooring system ensures that only limited lateral movement of the LNGC 2 with respect to FPSO 1 is possible under designed environmental forces on the vessel.

3) Identification of Objects of the Invention

A primary object of the invention is to provide an improved yoke and linkage design so that side-to-side relative motion (i.e., sway motion) between an LNG/FPSO and an LNG/shuttle tanker is greatly reduced from that of other yoke connecting arrangements. Reduction of side-to-side sway motions is highly beneficial to the LNG transfer system connected between the two vessels. The LNG transfer system will have higher reliability, greater safety, and lower cost as a result of reduced relative vessel motions.

Another object of the invention is to provide an improved disconnectable mooring device to connect an LNG/shuttle tanker or carrier to the LNG storage vessel that is intended for frequent connection and disconnection of the LNG carrier vessel in an offshore environment of at least Hs 2 meters wave height that causes relative motion between the two vessels.

Another object of the invention is to provide a disconnectable mechanical connection linkage that reduces the relative motions in the transverse direction to the FPSO vessel's longitudinal axis while not becoming too stiff and causing high forces in the fore-and-aft directions.

Another object of the invention is to provide a disconnectable mechanical connection linkage that has at least half as much resistance to lateral force (force stiffness) at the yoke tip connector as it has in the fore-and-aft vessel direction. Preferably, the linkage will be designed and arranged for a lateral resistance to force equal to or greater than the resistance in the fore-and-aft direction.

Another object of the invention is to provide a disconnectable mechanical connection linkage that effectively decouples the force stiffness in the lateral direction from the force stiffness in the fore-and-aft vessel direction.

Another object of the invention is to provide a disconnectable mechanical connection linkage whereby the force resistance in the carrier vessel's fore-and-aft direction is not greatly increased when the yoke tip and carrier vessel's bow connector has been displaced to an extreme position to one side. This action reduces the maximum linkage forces that occur at the extreme lateral displacements.

Another object of the invention is to provide an alternative disconnectable mechanical connection linkage whereby the fore-and-aft force stiffness is greater when the yoke is displaced sternward than it is when the yoke is displaced forward of its neutral position.

Another object of the invention is to provide an LNG transfer system to work in conjunction with conventional crane and boom fluid transfer arrangements with disconnectable mechanical connection linkages that, as a result of the reduced lateral relative motions of the LNGC, does not require rotation of the LNG transfer system boom about a vertical axis to follow the lateral motions of the LNGC vessel while the piping pantograph is connected to the LNGC.

Another object of the invention is to provide an LNG transfer system wherein a crane pedestal is located at a point outboard of the yoke links to achieve a minimum boom length for a given separation distance between the connected vessels.

Another object of the invention is to provide an alternative arrangement where a crane and boom assembly is eliminated in favor of a fixed cantilevered frame at the end of the FPSO with a pantograph coupling at the end of the frame.

SUMMARY OF THE INVENTION

The objects identified above as well as other advantages and features are incorporated in a Duplex Yoke Mooring System which includes a permanently moored process and storage vessel (LNG/FPSO), an offloading system attached to the stern of the LNG/FPSO vessel to transfer Liquid Natural Gas (LNG) or other product to an LNG/shuttle tanker (carrier), a disconnectable mechanical connection linkage comprising two and three-axis universal joints, two vertical links, a third torsionally resistant link structure, and a yoke structure with a connection apparatus at the yoke tip, so that the LNG carrier vessel is capable of selective connection or disconnection to the yoke tip.

Several improvements result from the arrangement according to the invention. The first is that a horizontally torsionally resistant third link is hinged to the yoke that spans across the lateral width of the yoke and provides a structure to decouple the force stiffness in fore-and-aft and lateral directions and allows an efficient design of the ratio of fore-and-aft direction force stiffness to lateral direction force stiffness. The second improvement is that the crane boom that supports the LNG piping or hose system and manifold apparatus remains fixed in one position while the LNG crane manifold remains connected to the moored carrier vessel. The third improvement is that the mounting of the crane pedestal is optimally located in order to minimize the boom length while providing maximum separation distance between the two connected vessels.

Another improvement, an alternative to the crane/boom arrangements mentioned above, provides a fixed frame cantilevered from the end of the FPSO with a pantograph fluid coupling for connection and disconnection with the LNGC where the mooring system provides limited lateral or longitudinal excursion of the LNGC with respect to the FPSO and the pantograph coupling is designed to accommodate such limited excursions.

BRIEF DESCRIPTION OF THE DRAWINGS

The invention is described by reference to the appended drawings, of which,

FIGS. 5A, 5B, 5E are schematic diagrams of link motions and forces of the prior art yoke, while

DETAILED DESCRIPTION OF PREFERRED EMBODIMENTS OF THE INVENTION

Figure 3:
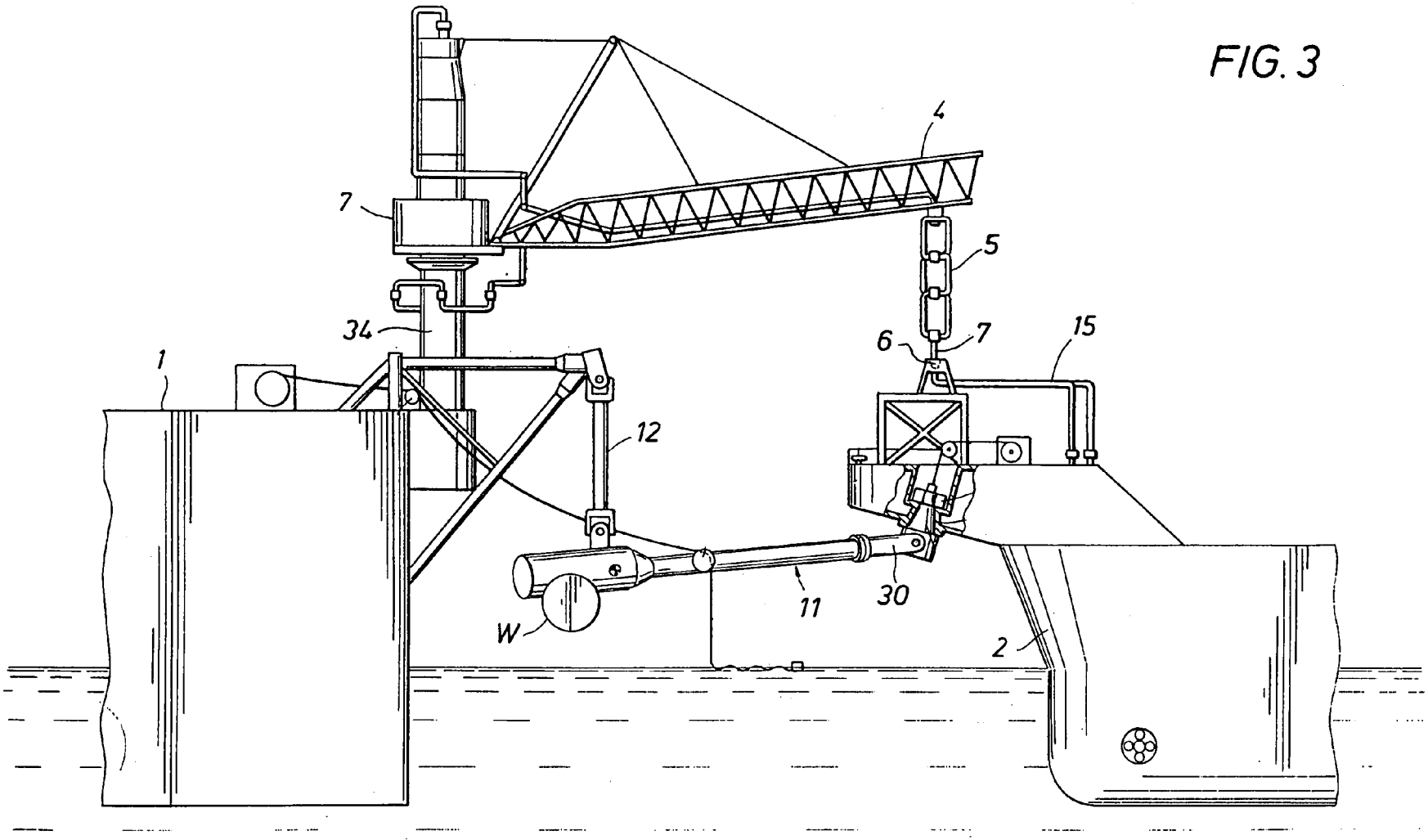
FIG. 3 illustrates an LNG transfer system with a disconnectable stern yoke mooring system in place of the hawser mooring of FIG. 1.

FIG. 3 shows a disconnectable stem yoke mooring system described in corresponding U.S. patent application Ser. No. 60/362,896 filed on Mar. 7, 2003 which claims priority from a provisional application filed on Mar. 8, 2002. The inventor of the present application is a coinventor of the subject matter of Ser. No. 60/362,896 application which is incorporated by reference herein. The mooring arrangement of FIG. 3 is characterized by a yoke structure 11 having a weight W placed at one end of the yoke. That end is pivotable about horizontal axes of one of the vessels, e.g., the LNG/FPSO 1, with the yoke structure 11 having an opposite end with a plug coupling arrangement P which is arranged and designed to be pulled into a receptacle on the LNG carrier 2 for selective coupling thereto. Liquid Natural Gas from the LNG/FPSO vessel 1 is transferred to the LNG carrier by means of a fluid conduit and pantograph arrangement 5 carried by a pedestal 34 mounted boom 4 which can be rotated to establish coupling with manifold connector 6 on the LNG carrier 2.

FIGS. 4A, 4B, 4C, 5A–5F and FIGS. 6A–6C, FIGS. 7A and 7C and FIGS. 8A and 8B illustrate an alternative yoke arrangement to that of FIG. 3. The following list provides correspondence of reference numbers in the drawings with names assigned to the various elements shown therein.

BRIEF IDENTIFICATION OF REFERENCE NUMBERS FOR ELEMENTS

1 LNG/FPSO vessel
2 LNG carrier vessel (LNGC)
3 LNG transfer system
4 Crane boom
5 Piping pantograph
6 LNG manifold connector
7 LNG carrier manifold
8 Hawser
9 Motion envelope
10 Disconnectable yoke mooring system
11 Weighted yoke structure
12 Links
13 Yoke tip connector
14 X-stiffness, $K_x$, force stiffness in the fore-and-aft direction, tonnes per meter
15 Y-stiffness, $K_y$, force stiffness in the transverse direction, tonnes per meter
16 Yoke support structure
17 Yoke
18 Hinged link
19 Link
20 Weights
21*a*, 21*b* Two-axis universal joint
22 Vertical axis rotation joint
23 Joining pin
24 Duplex yoke assembly
25 Hinged joint
26 Connector member
27 Elastomeric bumper
28 Retrieval line connector
29 Buoyant chamber
30 Yoke tip
31*a*,31*b* Bracket
32 Yoke structural framing
33*a*, 33*b* Hawser fairlead
34 Crane pedestal
35 Crane rotation lock device
36 Boom cradle
37 Manifold storage bracket
38 Torisonally stiff structure
39 Center of gravity (of hinged link 18)
40 Crane
41 Winch operator viewport
42 Winch
43*a*,43*b* Hawser
44*a*,44*b* Winch
45 Bow extension
46 Yoke connector
47 Tugboat
48 Swiveling pipe joint assembly

49 Flexible hose

50 Three-axis swivel joint

Figure 4A:
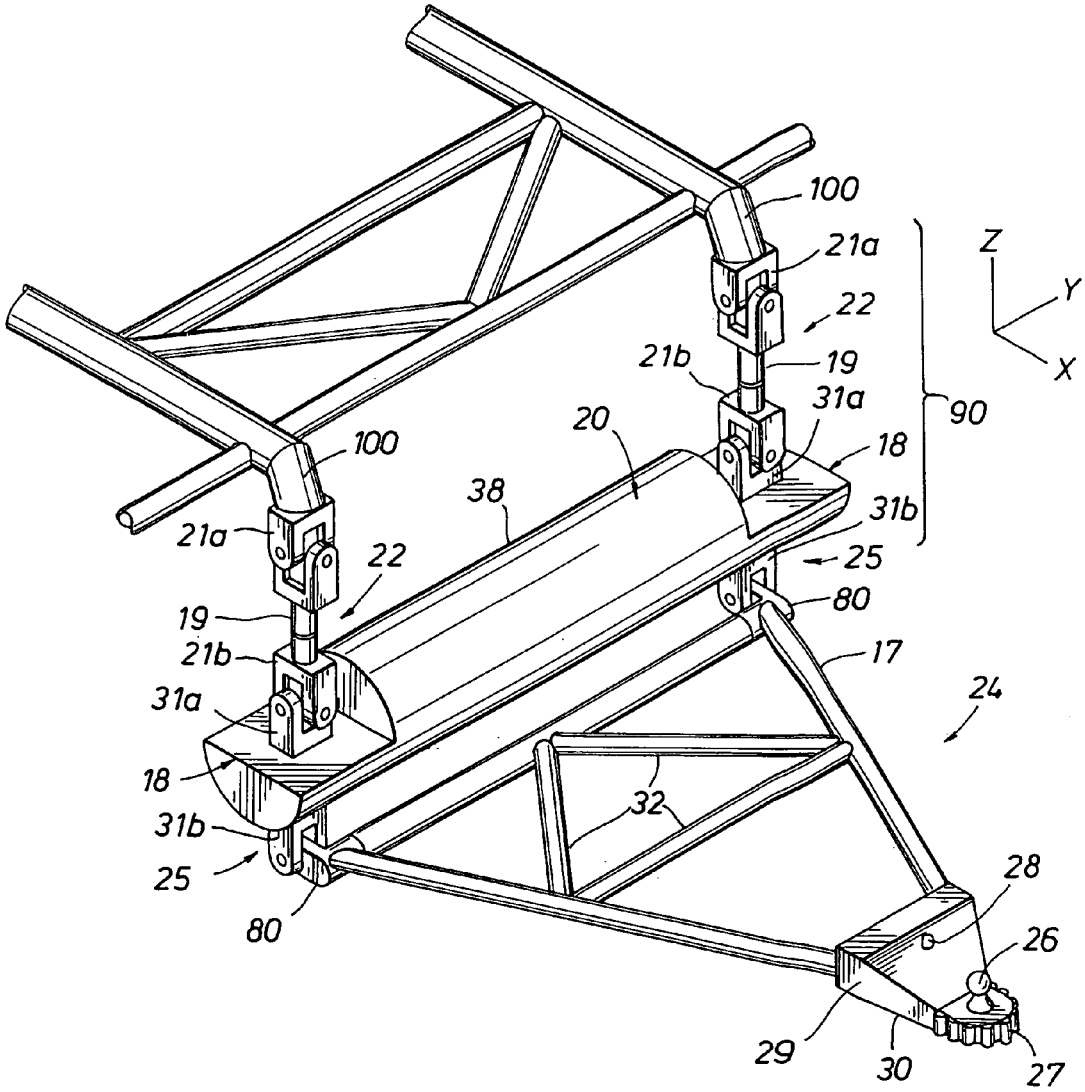
FIGS. 4A, 4B and 4C illustrate a duplex yoke general arrangement according to the invention.
Figure 4B:
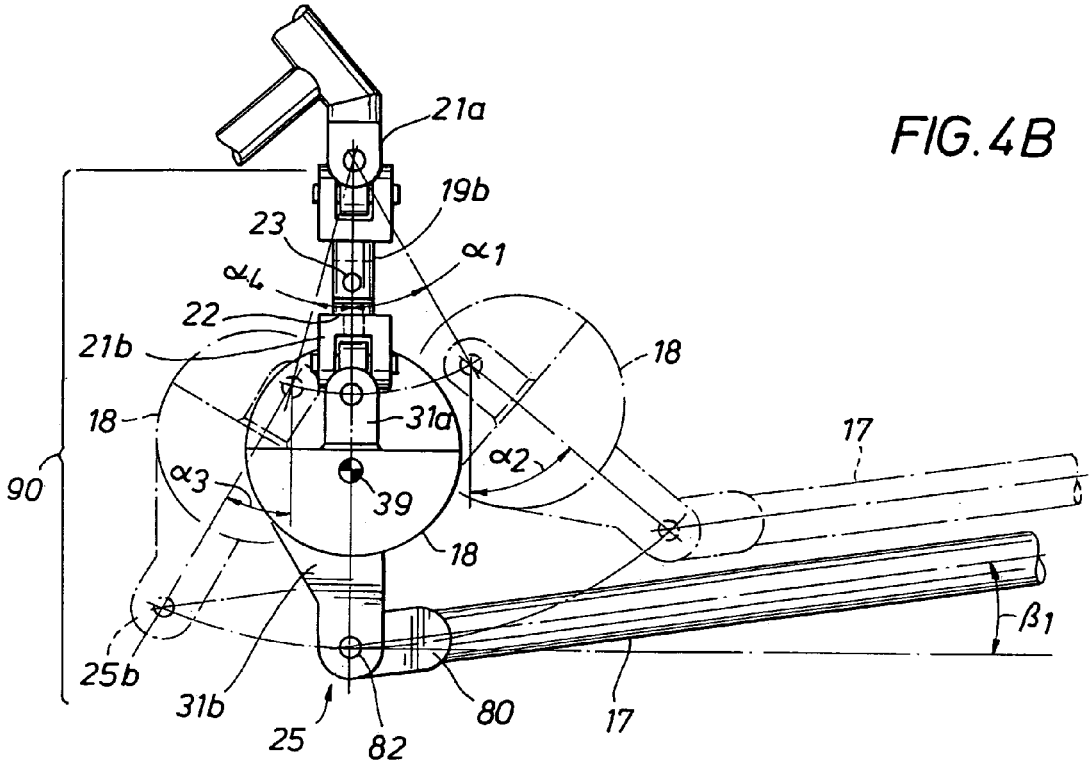

FIGS. 4A and 4B illustrate an embodiment of the duplex yoke assembly 24 according to the invention, so named because of the dual action of a connection assembly 90 between frame members 100 and the end of the yoke 17. The connection assembly includes a torsionally stiff structure 38 having hinged links 18 at each end thereof which are coupled at their top side via upper links 19 to frame members 100 carried by the LNG/FPSO 1. The links 18 are hinged at their bottom sides to end members 80 of the yoke 17. Two pairs of upper and lower two-axis universal joints 21*a*, 21*b* connect links 19 between the upper side of hinged links 18 and the frame members 100 at the aft of the LNG/FPSO 1. Link 19 provides for axial rotation allowing for relative rotational motion between joints 21*a* and 21*b* by means of vertical axis rotation joint 22. Rotation joint 22 can be placed between two-axis joints 21*a* and 21*b*, or alternatively joint 22 can be combined with either 21*a* or 21*b* to provide at least one three-axis joint within connection assembly 90. Brackets 31*a* connect the upper sides of hinged links 18 to universal joints 21*b*. Brackets 31*b* with pinned connections to end side members 80 of yoke 17 provide hinged joints 25 between the yoke 17 the connection assembly 90. The arrangement allows yoke 17 to twist, i.e., stiffly rotate in a horizontal plane (i.e., in the y-direction about a vertical axis) while the stiff structure 38 with hinged links 18 provides fore-and-aft pendulum motion (i.e., in the x-direction about a horizontal axis) substantially independently of the twisting motion.

Yoke 17, hinged at 25 to connection assembly 90 at end members 80 disposed at opposite sides of the yoke, includes yoke structural framing members 32, buoyant chamber 29, connector member 26, retrieval line connector 28, and an elastomeric bumper 27. Yoke tip connector member 26 is positioned at an elevation greater than the elevation of hinge joints 25 when duplex yoke 24 is connected to the LNG carrier 2 and both vessels are at their mean drafts. This results in an angle $\beta_1$, referenced to the horizontal which is greater than zero. (See FIG. 4B)

The duplex yoke assembly 24 can be applied to other mooring arrangements with advantage, such as tower yoke systems, where vessel and yoke jack-knifing can be a serious problem. The large lateral force capability of the duplex yoke reduces the jack-knife tendency when combined with known yoke tips with roll axis bearings and trunnion bearings for rotation of conventional turntables on top of the tower. Other applications of connecting two floating vessels together with one or more yokes requiring large lateral load capability are improved by utilization of the duplex yoke arrangement of FIGS. 4A and 4B. Fore-and-aft rotation positions of the stiff structure 38 and the yoke 17 are illustrated by dotted lines in FIG. 4B.

Figure 4C:
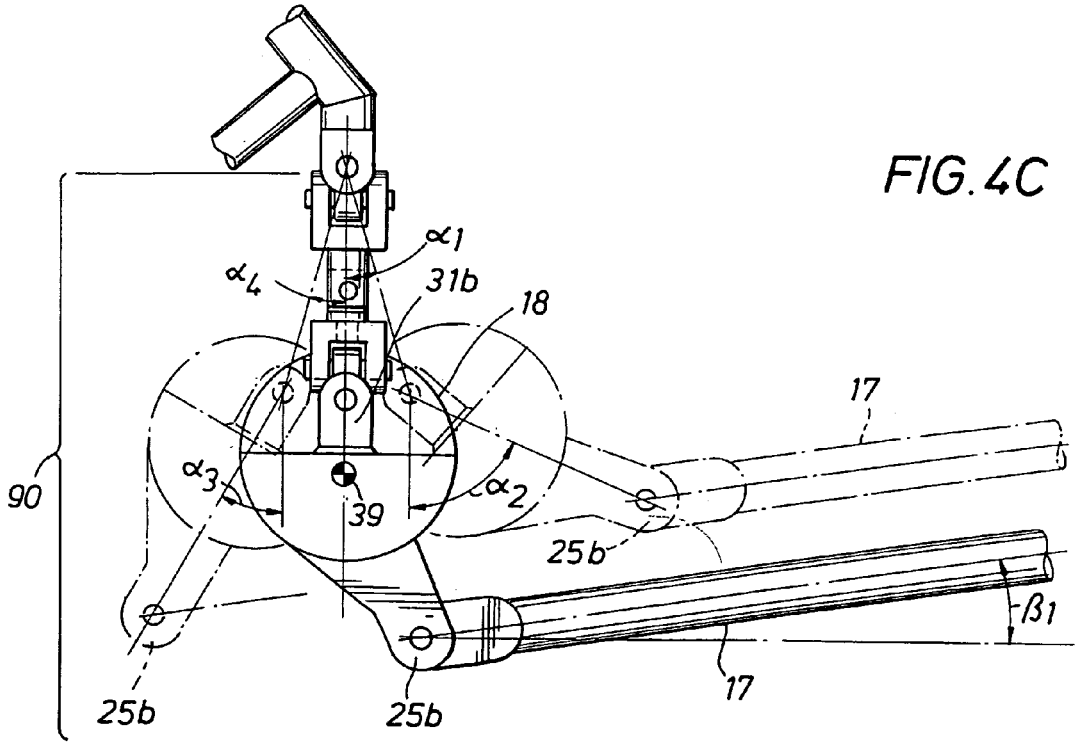

FIG. 4C shows another embodiment of hinged link 18 where hinge joints 25 are positioned to one side of a vertical line passing through center of gravity 39 of link 18. Joints 25, are positioned in the direction toward the tip of the yoke where connector 26 is placed. The advantage of this arrangement is that the linkage has more force stiffness in the aft direction than it does in the forward direction from the at-rest neutral position. This results in a mean vessel position closer to the calm water position than occurs with the FIG. 4B arrangement and provides a beneficial motion envelope of the LNG pantograph 5 or other fluid conductor arrangement. FIG. 4C also illustrates the position of yoke 17 and hinged link 18 during excursions of the yoke 17 in the x-direction.

Figure 5B:
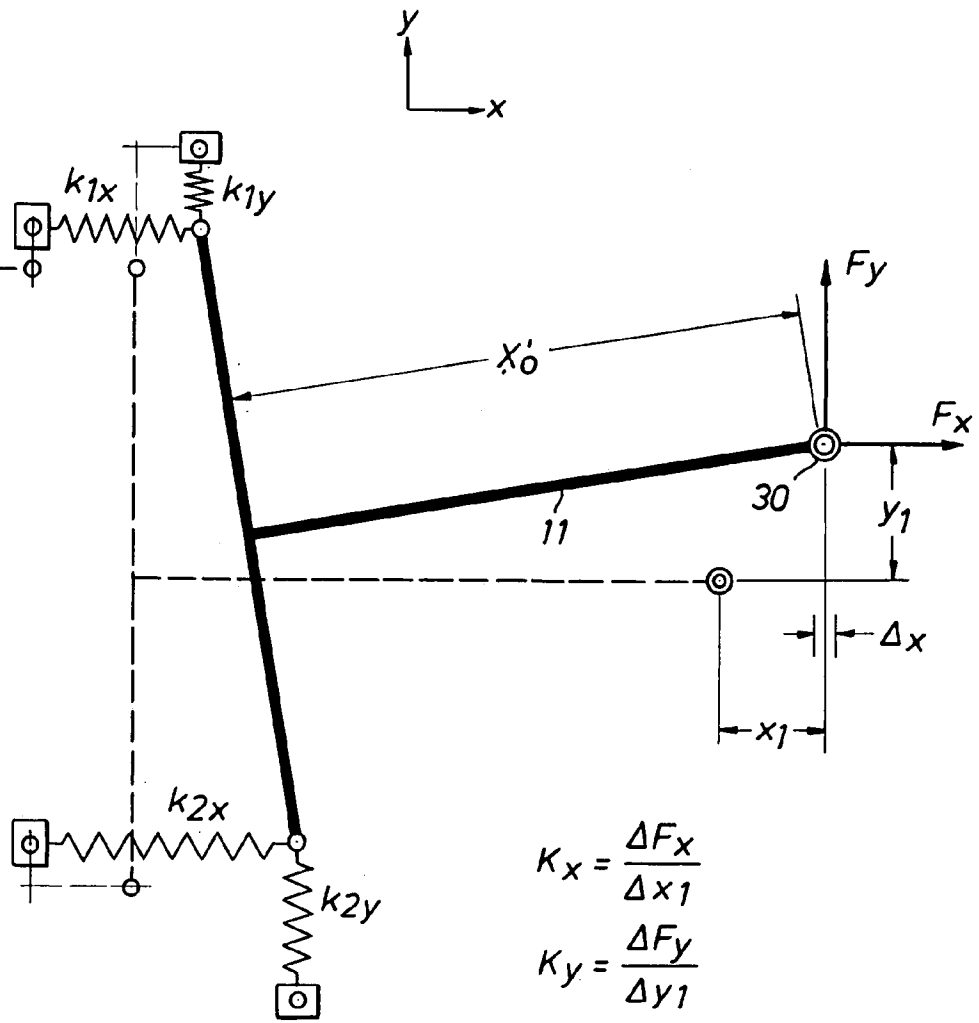
Figure 5A:
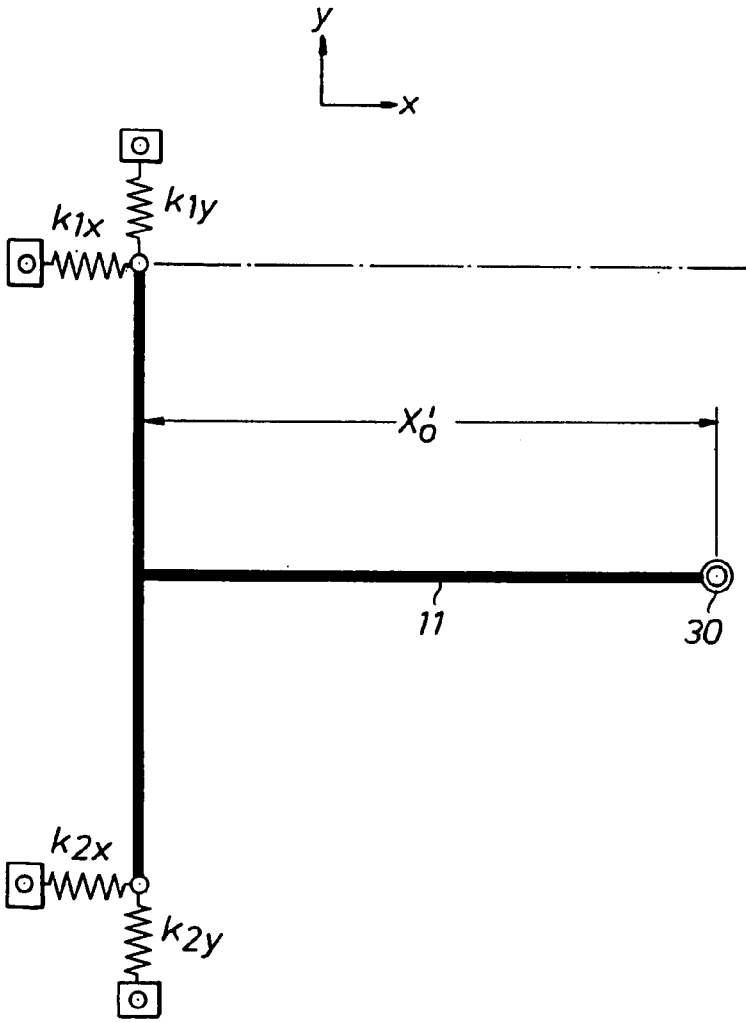

FIGS. 5A and 5B are schematic diagrams illustrating the approximate motion characteristics of the yoke arrangement 11 of FIG. 3. The pendulum action of links 12 supporting weighted yoke 11 can be approximated by a non-linear spring at the yoke support points. The non-linear spring components are represented as $k_{1x}$, $k_{1y}$, $k_{2x}$, $k_{2y}$. Applied forces $F_x$ and $F_y$ move the yoke tip 30 to displacements x1 and y1. The force stiffness at any point of deflection of the yoke tip 30 is then defined, as shown FIG. 5B as $$K_x = \frac{\Delta F_x}{\Delta X_1} \text{ and } K_y = \frac{\Delta F_y}{\Delta Y_1},$$

where $\Delta_x$ and $\Delta_y$ represent small displacement increments corresponding to small increments in forces $F_x$ and $F_y$ near any displacement $x_1$ and $y_1$. A rigorous three dimensional kinematic linkage analysis can accurately determine the actual forces at any displacement point. (Such an analysis is available to the art in the form of readily available engineering analysis computer software.) When a large $F_y$ force occurs and rotates yoke 11 to a large displacement y1, spring constants $k_{1x}$ and $k_{1y}$ increase rapidly. When this occurs, stiffness $K_x$ rapidly increases and severely restricts motions caused by a sudden increase in $F_x$. This condition can cause excessively large link forces when the yoke tip 30 is in the extreme corners of its operating displacement envelope. The yoke linkage arrangement of FIG. 3 with reasonable dimensions will typically have a force stiffness in the y-direction $K_y$ of 20% to 30% of $K_x$.

Figures 5C, 5D:
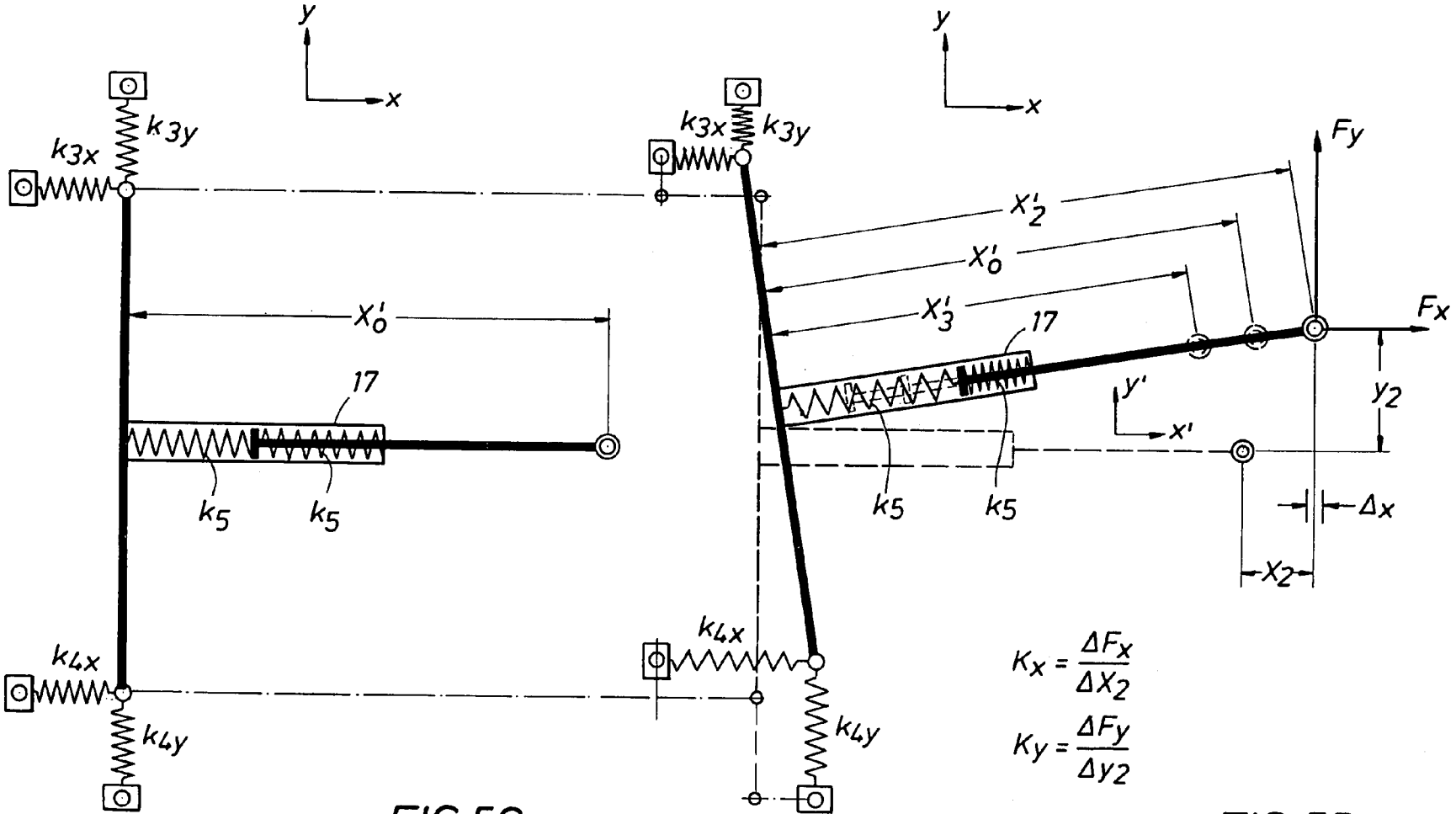
FIGS. 5C, 5D and 5F are diagrams of link motions and forces acting on the yoke according to the invention.

FIGS. 5C and 5D are schematic diagrams illustrating the approximate motion characteristics of the embodiment of this invention as shown in FIGS. 4A, 4B, and 4C. The connection assembly 90 provides an additional spring action represented by a spring constant $k_5$. This arrangement provides an additional spring action when yoke 17 has been rotated by an Fy force. Springs $k_3$ and $k_4$ can be at their maximum displacement, but when an increase in Fx occurs, $k_5$ readily allows a large $x_2$ displacement, even across the center position to the negative x-direction. This action is not possible with weighted yoke structure 11 of FIG. 3 and FIG. 5A. The primary advantage of the duplex yoke assembly 24 according to the invention is that the ratio of $K_y/K_x$ can be greatly increased, and as a result, $K_y$ can be made equal to or greater than $K_x$ while maintaining the capability for storing a large level of potential energy. This means that a given transverse force in the y-direction will move the yoke tip less than or equal to the x-direction displacement that an x-direction force of the same magnitude will move the yoke tip.

Figure 5E:
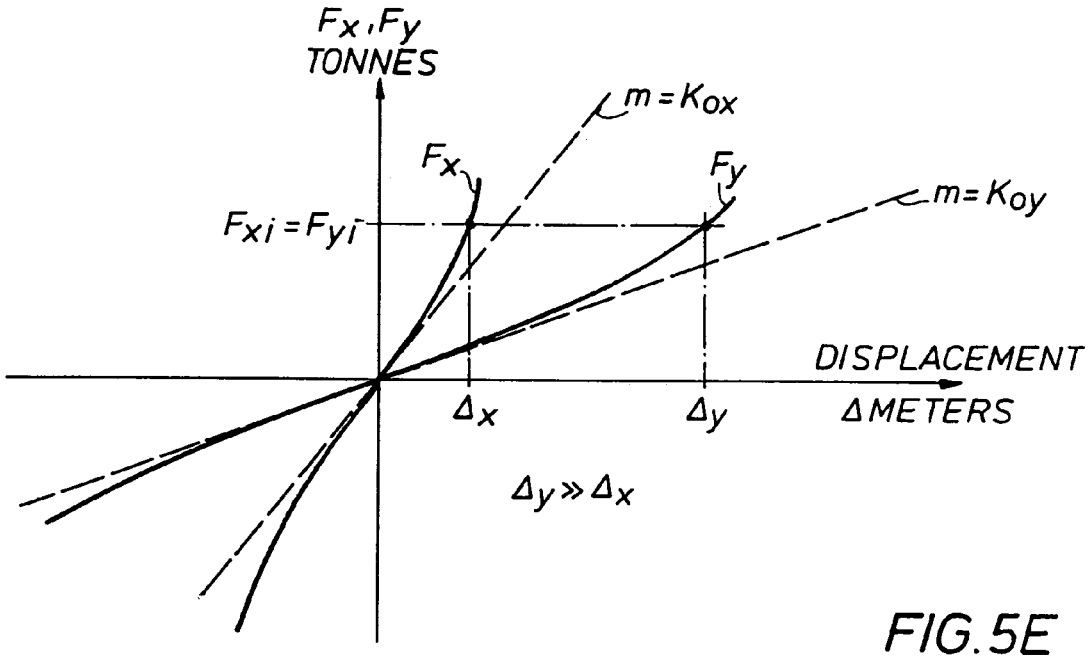

FIG. 5E shows a generalized graph of force deflection characteristic curves for the weighted yoke of the arrangement of FIG. 3 where y-deflection is much greater than x-deflection for a given force. Such large y-deflection must be followed by a large deflection of the pantograph 5 and crane boom 4.

Figure 5F:
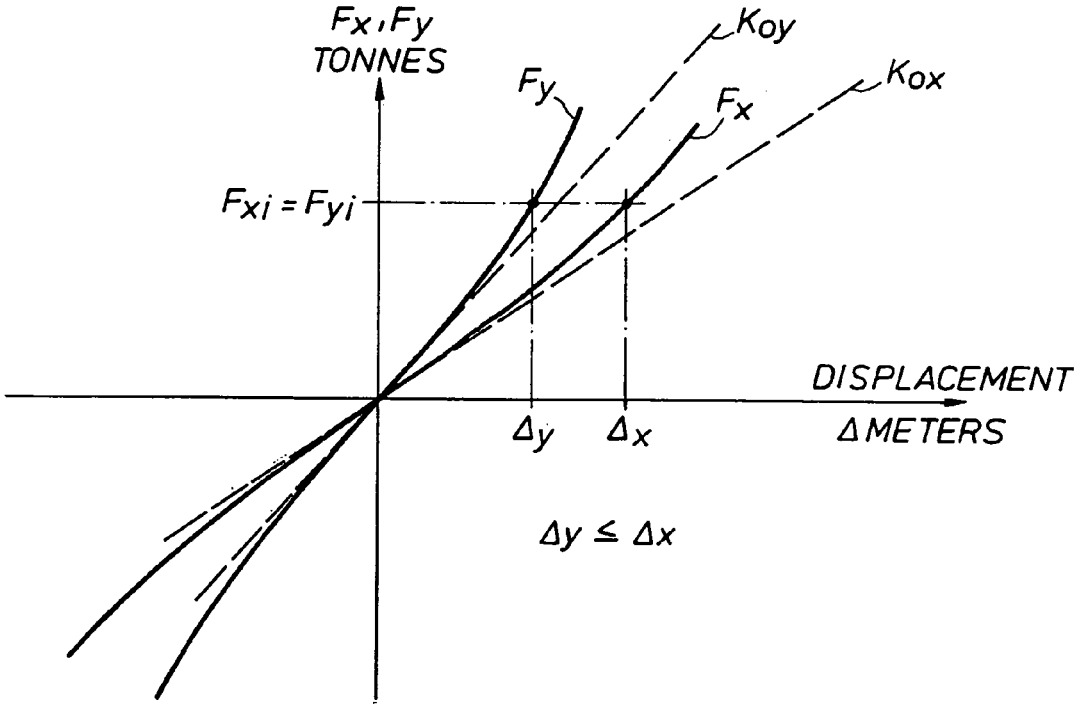

FIG. 5F shows a generalized graph of force deflection characteristic curves for the duplex yoke embodiment of the present invention of FIGS. 4A–4C where y-deflection is less than the x-deflection for a given force.

As was mentioned above, an object of the invention is to provide a coupling arrangement where the x-direction stiffness $K_x$ is less than twice the stiffness $K_y$, that is $$K_x \leq 2K_y$$

or equivalently, $K_y \geqq 0.5K_x$

Thus, a desirable minimum value of stiffness $K_y$ is equal to or greater than $0.5K_x$; an even more desirable value of $K_y$ is equal to $K_x$ as mentioned above.

As an explanation as to how a designer would achieve such ratios of $K_x$ and $K_y$, assume that $K_x$ is held constant and then determine hod $K_y$ can be increased or decreased while $K_x$ is held constant. As explained above, the term "stiffness" refers to the force or load applied to connector member 26 ( in the coordinate directions of x or y as the case may be) divided by the distance that connector member 26 moves in thos same x or y directions. (See FIG. 5B). As explained above, a rigorous three dimensional kinematic analysis with readily available engineering analysis software, is necessary to precisely determine the stiffness and the x and y directions of connector 26 with respect to the frame member 100 (See FIG. 4A). This is so because stiffness is not linear for the arrangement of FIG. 4A but varies with the angles of upper links 19 and hinged link 18 in a complex kinematic manner. However, a designer in the mchanical arts will appreciate the predominate variables by inspection of FIG. 4A and by reference to FIGS. 4B and 4C and the graphys of FIGS. 5C, 5D, and FIG. 5F.

An object of the invention as mentioned above is to increase the stiffness in the transverse (y) direction while the longitudinal axis (x) does not become too stiff. The approximate ideal design will have $K_y$ being equal to the value of $K_x$. Therefore for descriptive purposes, the factors that increase the y-direction stiffness $K_y$ without appreciably increasing or decreasing $K_x$ are described.

Referring to FIGS. 4A and 4B and as mentioned above, the arrangement allows yoke 17 to twist, i.e., stiffly rotate in a horizontal plane (i.e., in the y-direction about a vertical axis) while the stiff structure 38 with hinged links 18 provide a fore-and-aft pendulum motion (i.e., in the x-direction about a horizontal axis) substantially independently of the twisting motion.

FIG. 4B shows an end view of the linkages, as seen looking along the y-axis. The pendulum action is accomplished by the upper two axis universal joint 21*a*, the lower two axis universal joint 21*b* and hinged joint 25. A force acting on yoke 17 only in the x-axis direction ($F_x$) can be seen to cause a compound pendulum action of the linkage that swings center of gravity 39 away from its neutral position and results in a displacement of connector member 26. Under force $F_x$, all rotation motion of the links occur about pivot pins (of universal joints 21*a*, 21*b*, and hinged joint 25) with the pin axis lying parallel to the yaxis.

FIG. 4A shows the two sets of upper links 19 and hinged link 18 coupled to frame members 100 spaced apart by some distance. By inspection it is evident that the distance between the two frame members 100 and their coupled upper links 19 has no effect on the swinging displacement of the links and yoke 17 in response to only an x-direction force $F_x$. The distance between frame members 100 can be inccreased or decreased without x-direction effect.

Returning to FIG. 4B, if a y-direction force ($F_x$) is applied to the linkage of the center of gravity 39 instead of a connector member 26, a pendulum motion of the linkages occurs at only the pivot pins aligned with the x-axis of all four universal joings 21*a* and 21*b*. By inspection, the distance between frame members 100 again has no effect on this motion of the links. Also, it is evideent that the sideways y-displacement of yoke 17 should be much smaller, i.e., the y-direction stiffness is large, as compared to motions resulting from a same magnitude force acting only in the x-direction. This effect should be recognized, but such effect is not dominant for purposes of this description. No rotational motion of yoke 17 occurs about a vertical axis when force $F_y$ is applied at center of gravity 39.

Referring again to FIG. 4A, if only a force $F_y$ is applied at connector member 26, then the yoke rotates about a vertical axis. By inspection it is evident that a first upper link 19 swings forward and a second upper link 19 swings in the opposite direction while center of gravity 39 in FIG. 4B remains in its neutral hanging position. However, center of gravity 39 rises upward as upper links 19 rotate in opposite directions. This rising motion center of gravity 39 stores potential energy and results in the predominant spring-like restoring force at connector member 26. In addition to the opposite motion of links 19, the pendulum motion described above does not add slightly, but inconsequentially, to the y-direction motion measured as member 26.

Referring still to FIG. 4A and from the explanations above, it is evident that the dominant geometric proportions affecting the ration of $K_x$ to $K_y$ are:

a. the distances from upper joints 21*a* to lower joints 21*b*
b. the distance between lower joints 21*b* and hinge joint 25
c. length of yoke 17 from joint 25 to connector member 26, and
d. y-direction distance from first upper link 18 to second upper link 19

Assume that the distance of a. and b. remain the same.

In FIG. 4A, if the yoke 17 length is increased, with all else remaining the same, it is evident that the force required at member 26 to move member 26 in the y-direction decreases because of the lessening swing action of links 19 relative to distance traveled at member 26. Conversely, if the length of yoke 17 is decreased, then the force to move member 26 increases in thge y-direction, but the force to move member 26 in the x-direction is virtually unaffected. In this case, $$K_y = \frac{F_y}{\Delta_y}$$

increases withoud $K_x$ increasing.

The effects described above can be combined to increase the force necessary to move member 26 in the y-direction without increasing the x-direction stiffness. If yoke 17 length is descresed while the y-direction distance from first upper link 19 to second link 19 is increased, then the effects multiply together to dramatically increase the y-direction force $F_y$ to move member 26 a distance $\Delta_y$, while $F_x$ remains unchanged to move member 27 a distance $\Delta_x = \Delta_y$. Thus, a skilled designer adjusts the yoke length 17 and the y-direction distance from first upper link 19 to the second link 19, while maintaining the other parameters of the arrangement of FIG. 4A until a desired ratio of $$\frac{K_y}{K_x}$$

is achieved, i.e., at a minimum $K_y \geqq 0.5K_x$ and ideally, $K_y = K_x$.

Figure 6A:
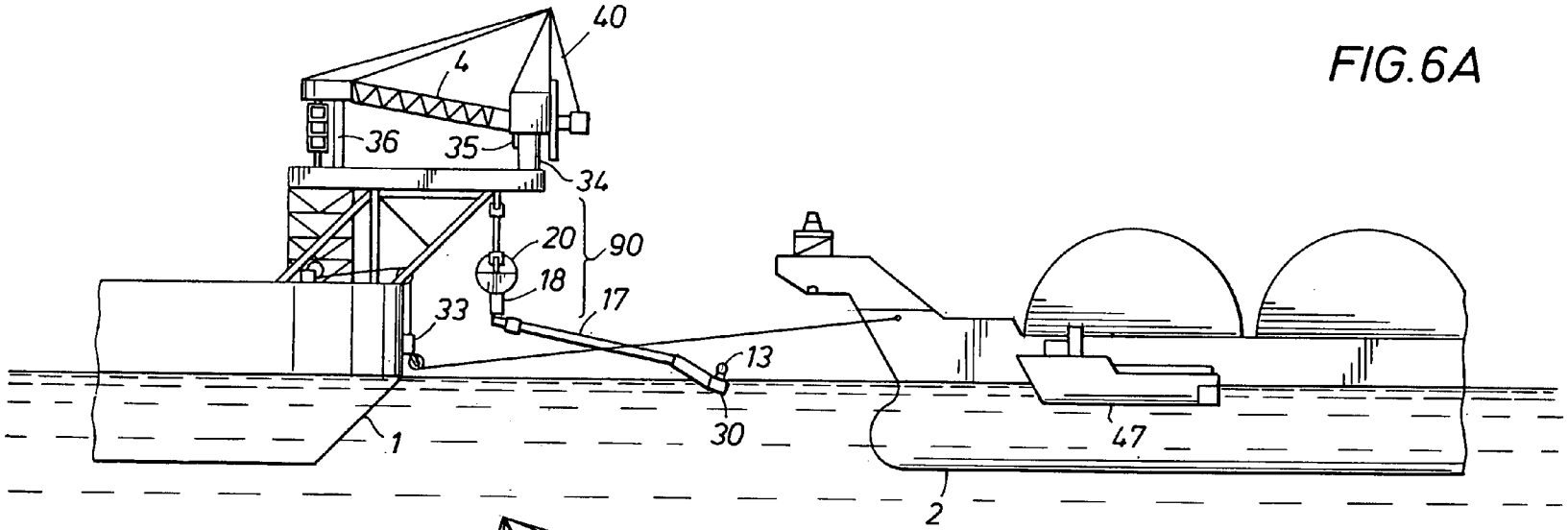
FIGS. 6A–6C illustrate a sequence of steps for connecting the LNG carrier to the LNG/FPSO.
Figure 6B:
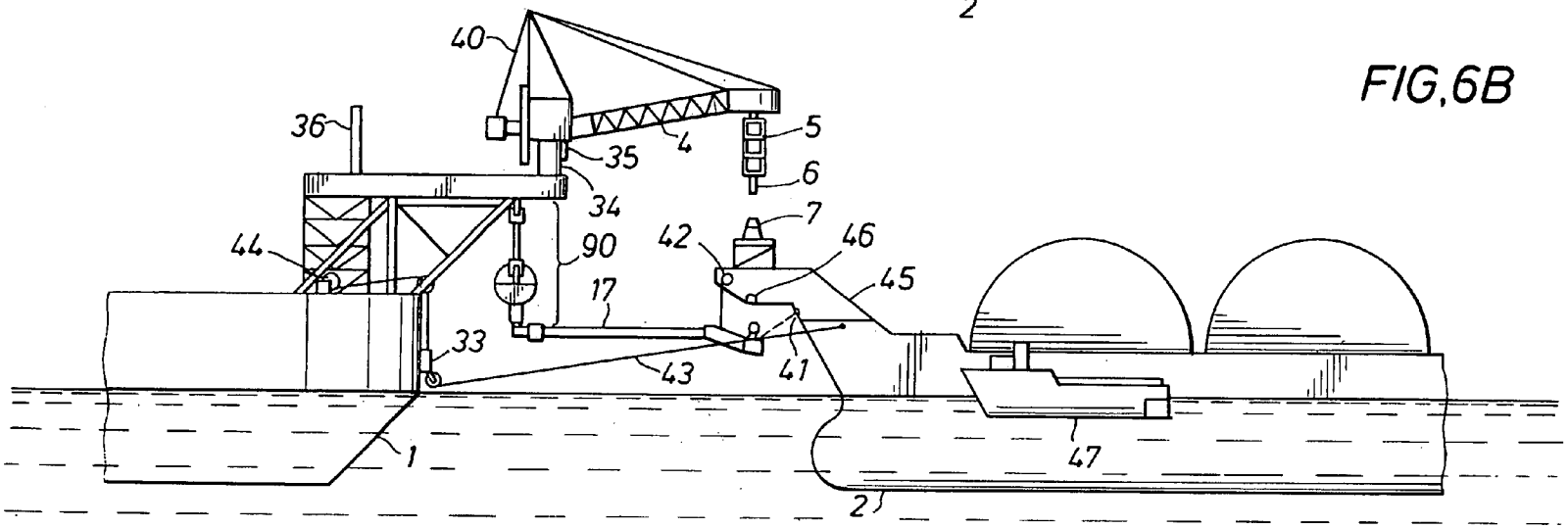
Figure 6C:
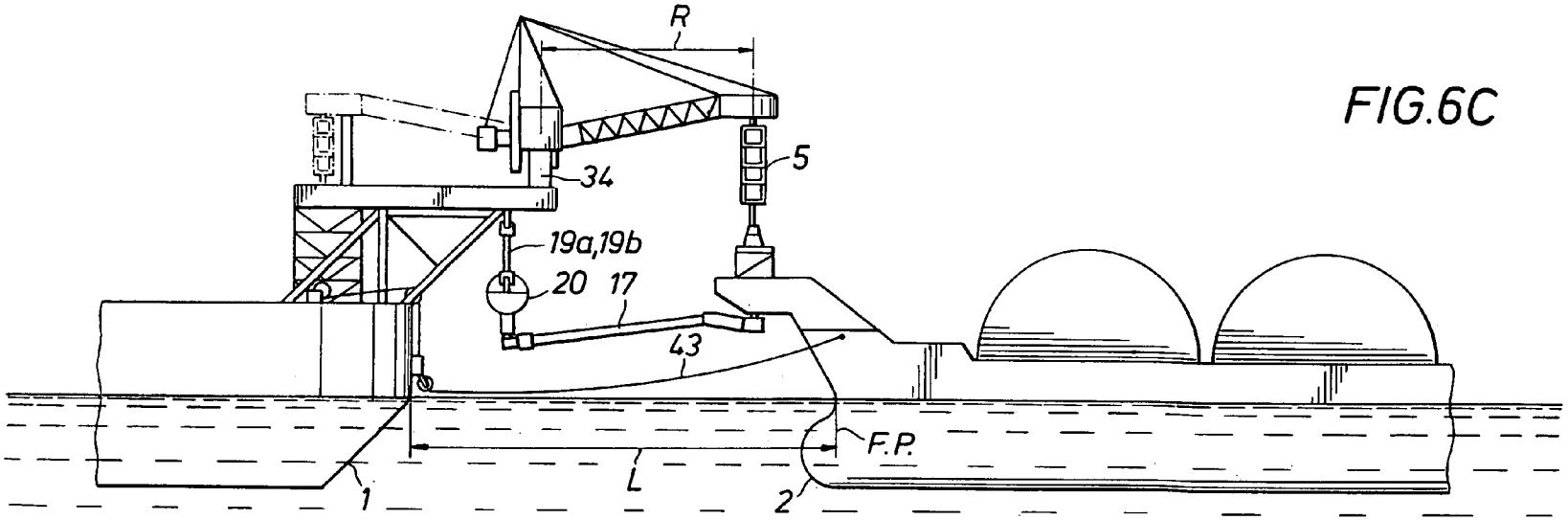

FIGS. 6A, 6B, and 6C illustrate a basic sequence for connecting an LNGC/carrier vessel 2 to LNG/FPSO vessel 1 in combination with a slewing (rotation about the vertical axis) crane 40. Boom 4 can be stored in the forward position on cradle 36 as shown in FIG. 6A, then rotated to the aft position as shown in FIG. 6B. Crane rotation lock 35 secures boom 4 in its offloading position. Lock 35 can be fitted with an emergency break-a-way device for fault condition overloads. Yoke tip 30 includes a buoyant chamber 29 (see FIG. 4A) that supports yoke 11 in the sea while disconnected and just prior to being hoisted up into connector engagement by LNG/carrier vessel 2. A constant tension winch on vessel 1 for hoisting yoke 17 (e.g., see the hoisting arrangement of FIG. 3) out of the water and partially balancing yoke 17 may be provided, thereby reducing the effort required by a winch 42 on bow extension 45 to lift yoke tip 30. LNG/carrier 2 is towed into connecting range by hawsers 43 powered by winches 44 located on opposite sides of vessel 1. Hawsers 43 (one on each side of the vessel) are routed down and through fairleads 33 to maintain the hawsers below interference from yoke 17. LNG/carrier vessel 2 maneuvering may be aided by vessel 2 dynamic positioning (DP) thrusters (see for example FIG. 3) and/or one or more tugboats 47.

FIG. 6B shows yoke tip 30 being hoisted by winch 42 as its operator observes through view port 41 beneath the vessel 2 bow extension 45. Bow extension 45 forms the supporting structure for LNG carrier manifold 7 and hydraulic connector 46.

FIG. 6C shows the two vessels connected, the LNG transfer system connected, and hawsers 43 with their tension slacked off. FIG. 6C shows a preferred embodiment wherein crane pedestal 34 is positioned outboard of links 19 such that the cranes' slewing arc radius R of the crane manifold 6 is not larger than one half of the separation distance L between the stem of vessel 1 and the forward perpendicular (F.P.) of vessel 2.

Figure 7A:
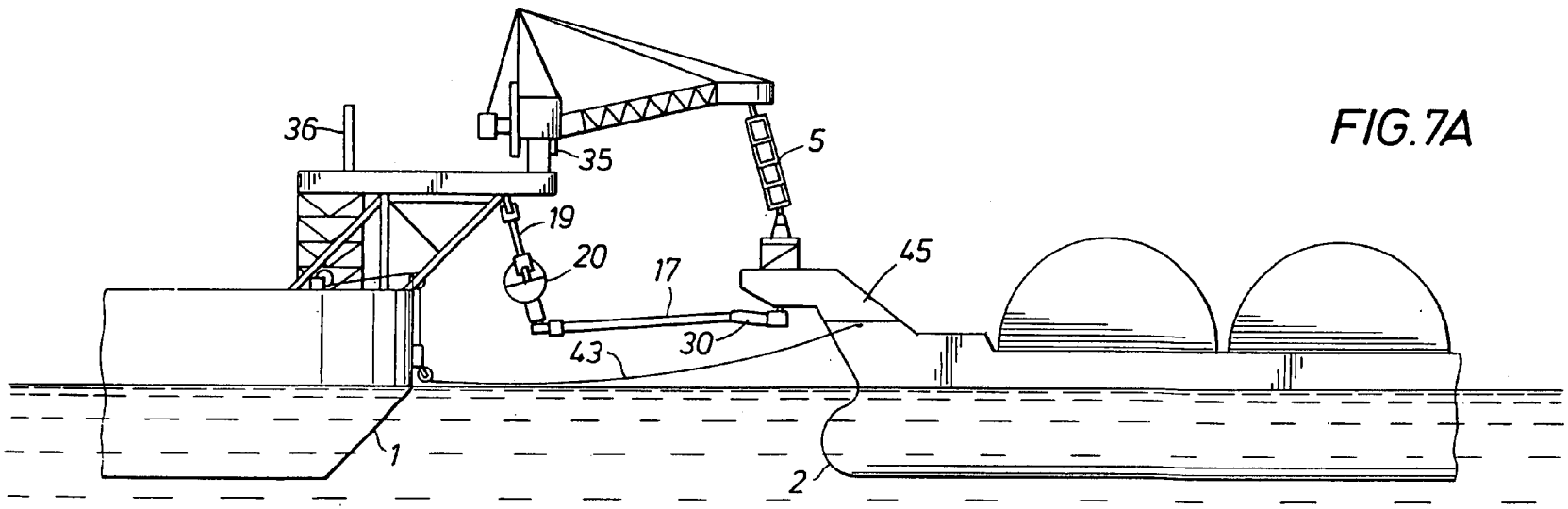
FIGS. 7A–7C illustrate a sequence of steps for disconnecting the LNG carrier from the LNG/FPSO.
Figure 7B:
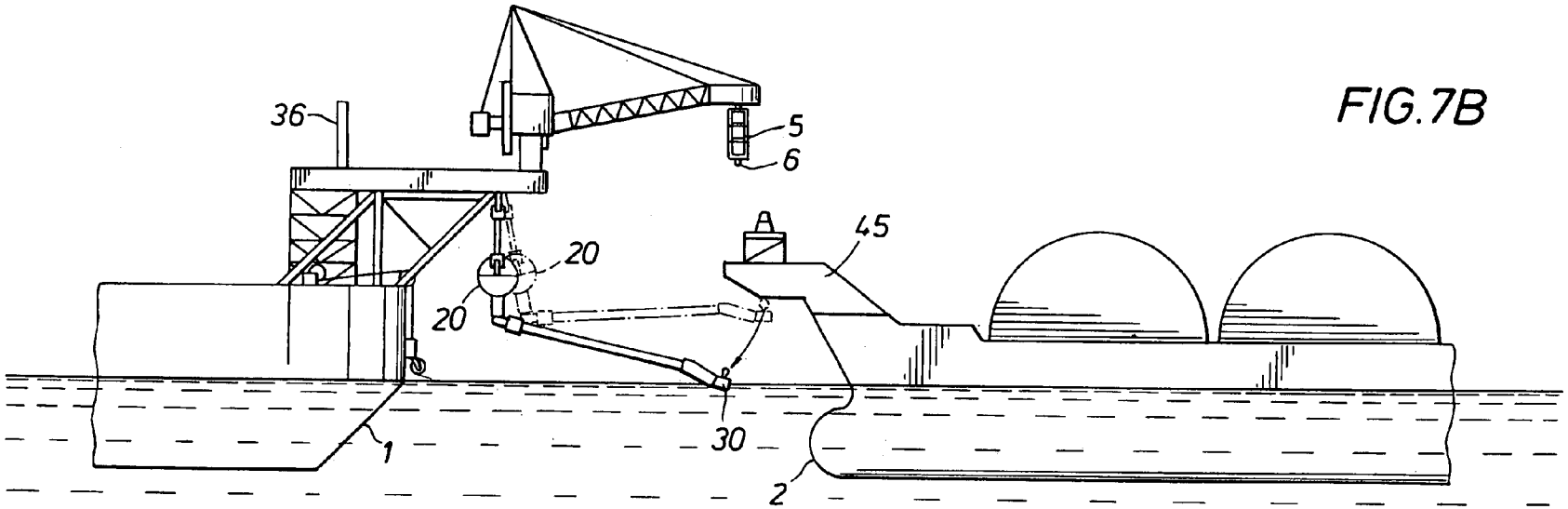
Figure 7C:
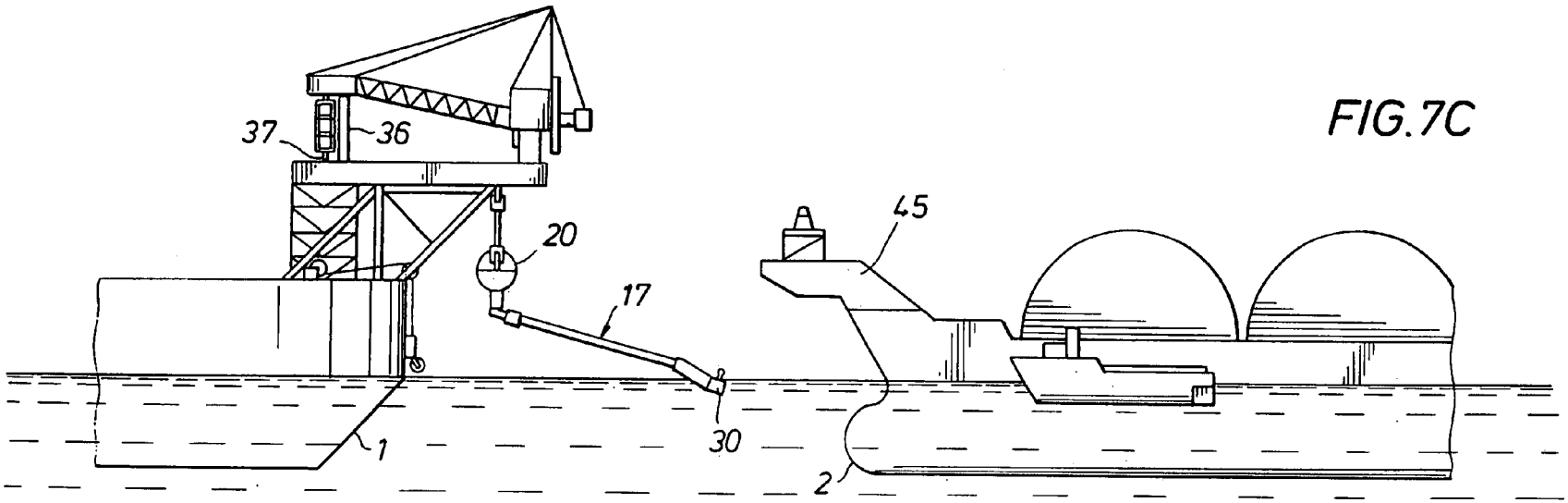

FIGS. 7A, 7B, and 7C show the basic sequence of disconnecting LNG/carrier vessel 2 from LNG/FPSO vessel 1. A serious problem can occur with other disconnectable yokes during a disconnection while vessel 2 is at a displaced position. When the yoke is released, it can move away quickly and then immediately swing back into vessel 2 with an uncontrolled flailing motion. The preferred embodiment of this invention eliminates this potential problem by providing that the yoke tip 30 be positioned below bow extension 45 and yoke connector 26. Yoke tip 30 is not counterbalanced, so that upon disconnection, yoke tip 30 plunges into the sea, typically with enough force to go below sea surface, thereby damping any return of yoke tip 30 back into collision with vessel 2. The slightly buoyant chamber 29 (see FIG. 3A) of yoke tip 30 then returns yoke tip 30 to the sea surface.

Figure 8A:
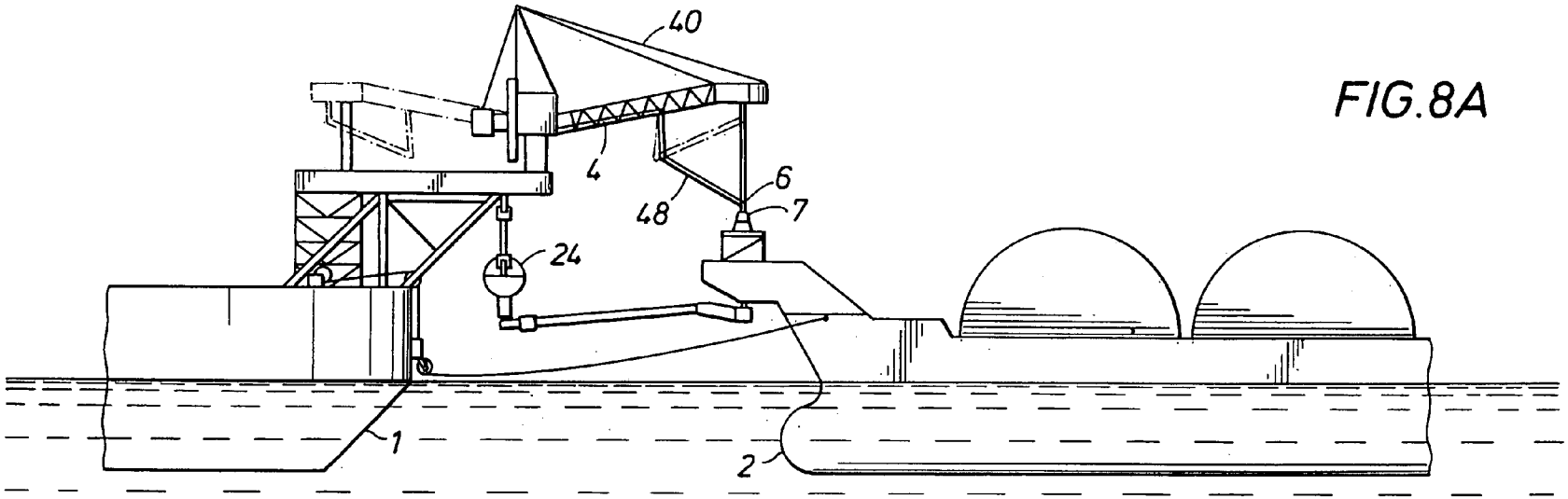
FIGS. 8A–8B illustrate other embodiments for fluid transfer arrangements between the LNG/FPSO and carrier.

FIG. 8A illustrates another arrangement of a combination of duplex yoke assembly 24 and an LNG offloading system wherein swiveling pipe assembly 48 is suspended below boom 4. Crane 40 carries manifold 6 during engagement with tanker manifold 7.

Figure 8B:
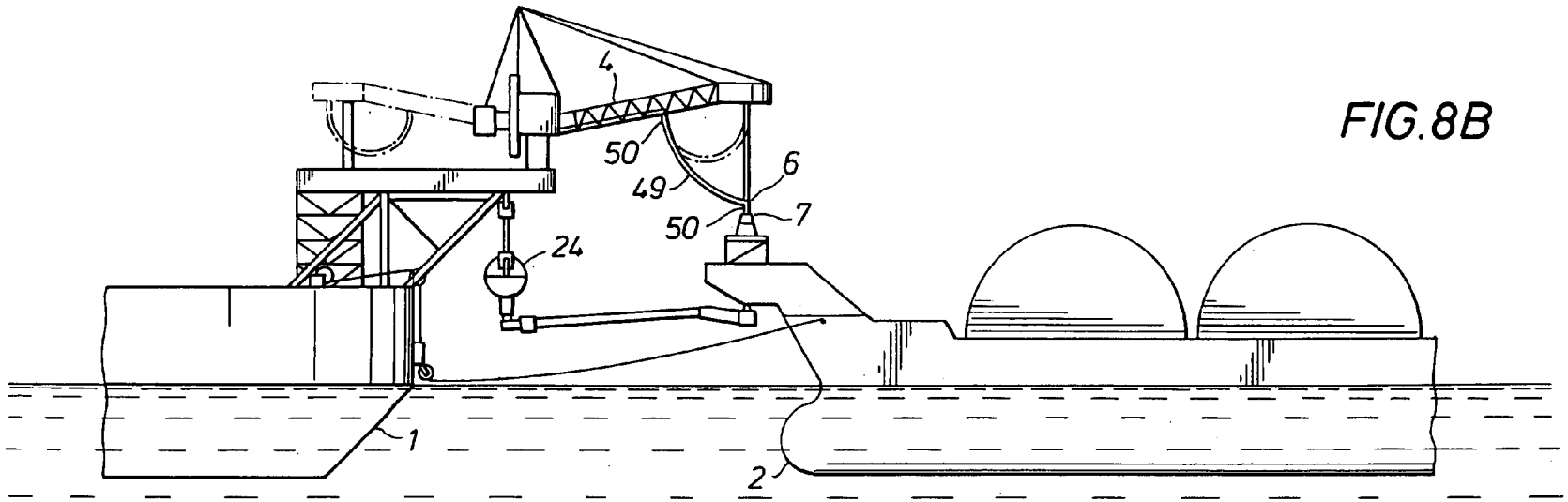

FIG. 8B shows another arrangement of a combination of duplex yoke assembly 24 and an offloading system where flexible hoses 49 are used to transfer LNG and vapor between the vessels. Hoses 49 are suspended beneath boom 4 and are connected at both ends by three-axis swivel joints 50 to accommodate the stiffness of hoses 49 while flexing through the three dimensional displacements of vessel manifold 7.

Figures 9A, 9B, 9C:
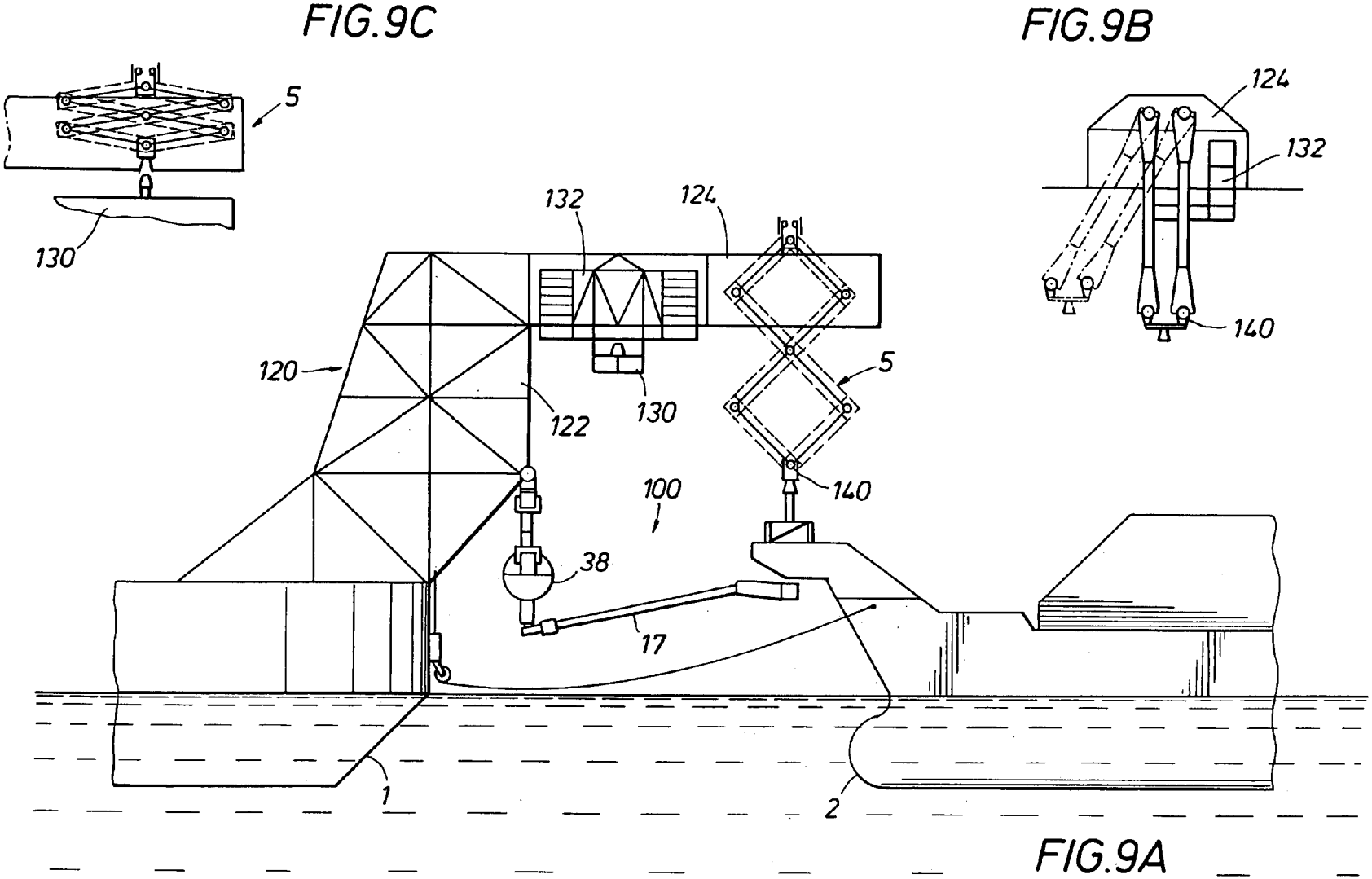
FIGS. 9A–9C illustrate a fixed frame with a pantograph fluid coupling for providing a fluid flow path between an LNG/FPSO and a LNGC carrier.

FIG. 9A illustrates an alternative arrangement for providing a fluid path between the LNG/FPSO 1 and the LNGC vessel 2. Because the mooring system 100, as illustrated in FIGS. 4A, 4B and 4C insures limited side to side and back and forth motion of LNGC 2 relative to FPSO 1, the capability of a manifold connecter 6 to accommodate that motion can be employed. The connector 6 is mounted on a frame 120 that is secured to the end of vessel 1. As mentioned previously, a commercially available pantograph 5 allows horizontal motion such as within a circle of 12 meters radius, and the mooring arrangement 100 can be designed as described above to limit motion of the bow of LNGC vessel 2 to be within that range. In other words, the mooring arrangement 100 insures that the bow of vessel 2 moves within a 12 meter radius circle, where the center of that circle represents dead calm seas with no environmental forces on vessel 2.

The frame 120 is designed and arranged to include a vertical portion 122 which supports a cantilevered horizontal portion 124. The piping pantograph 5 is mounted on the end of horizontal portion 124 away from vertical portion 122. A service platform 130 is suspended beneath trolley 132 which can move to a service position below fluid coupling 140 when pantograph 5 is folded into its stored position as illustrated in FIG. 9C.

Figure 1:
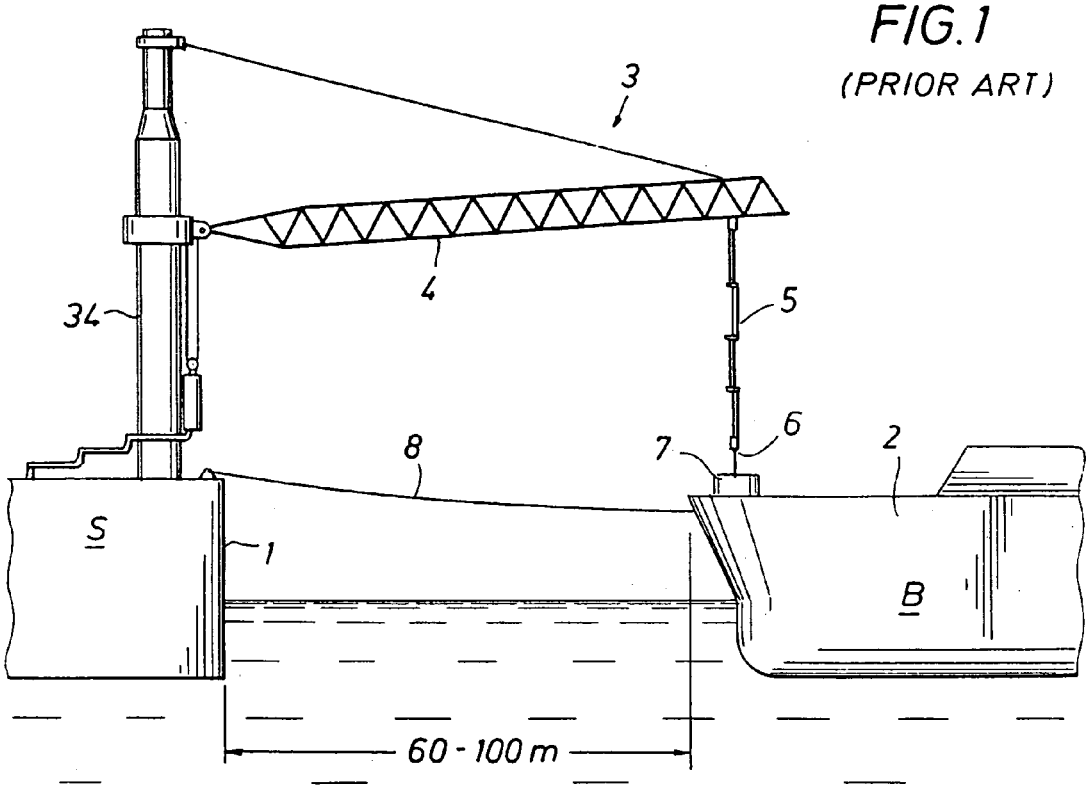
FIG. 1 (PRIOR ART)
FIG. 1 illustrates a prior art LNG transfer system with hawser moored LNG Carrier showing example dimensions.
Figure 2:
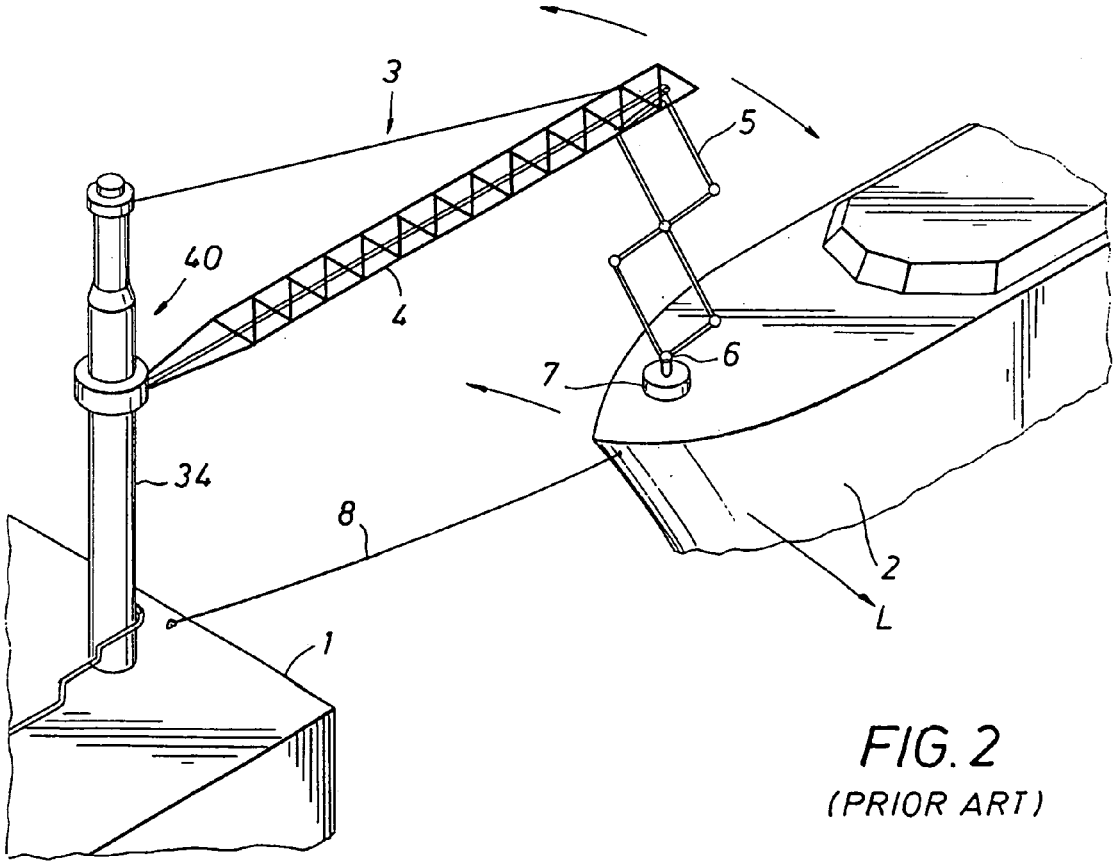
FIG. 2 (PRIOR ART)
FIG. 2 illustrates an elevation view of the prior art LNG transfer system of FIG. 1.

An important advantage of the fixed frame with a pantograph fluid coupling mounted as illustrated in FIG. 9A is the elimination of the crane 40 of the arrangement illustrated in FIG. 2. In operation, the vessel 2 is connected to the mooring 100, while the pantograph 5 is in its upward stored position. Then the pantograph 5 is connected to the vessel 2 with the fluid connector 140 coupled to piping on the bow of the vessel 2. The steps are reversed when the vessel 2 is to be uncoupled from FPSO 1.

What is claimed is:

1. A yoke assembly for mooring a vessel to a body comprising, a yoke (17) having a first end and a second end, with said first end arranged and designed for coupling with either said vessel or with said body and said second end arranged and designed for coupling with a frame (100) non-rotatably fixed to said body or to said vessel, said second end having first and second side members (80) and a connection assembly (90) including, a torsionally stiff weighted member (38) having a hinged link (18) at first and second ends, said hinged link having upper and lower sides, first and second hinges (25) coupling said lower side of said hinged links (18) of said stiff member at said first and second ends thereof to said first and second side members of said second end of said yoke, and first and second links (19) coupled to said frame and to said upper side of said hinged links (18) by first and second pairs (21*a*, 21*b*) of two axis universal joints.

2. The yoke assembly of claim 1 wherein said first end of said yoke is arranged and designed for connection to a carrier vessel, and said second end of said yoke is arranged and designed for connection to said body.

3. The yoke assembly of claim 2 wherein said body is a floating body.

4. The yoke assembly of claim 3 wherein said vessel is an LNG carrier vessel, and said floating body is an LNG/FPSO.

5. The yoke assembly of claim 1 wherein said first and second hinges (25) include first and second lower brackets 31(*b*) extending from the lower side of said hinged links (18), with first and second pins (82) extending through aligned holes in said brackets 31(*b*) and said first and second side members (80).

6. A yoke assembly for mooring a vessel to a body comprising, a yoke (17) having a first end and a second end, with said first end arranged and desired for coupling with either said vessel or with said body and said second end arranged and designed for coupling with a frame (100) carried by said body of by said vessel, said second end having first and second side members (80) and a connection assembly (90) including, a torsionally stiff weighted member (38) having a hinged link (18) at first and second ends, said hinged link having upper and lower sides, first and second hinges (25) coupling said lower side of said hinged links (18) of said stiff member at said first and second ends thereof to said first and second side members of said second end of said yoke, first and second links (19) coupled to said frame and to said upper side of said hinged links (18) by first and second pairs (21*a*, 21*b*) of two axis universal joints, and said first and second hinges (25) including first and second lower brackets 31(*b*) extending from the lower side of said hinged links (18), with first and second pairs (82) extending through aligned holes in said brackets 31(*b*) and said first and second side members (80), wherein first and second upper brackets 31(*a*) extend from the upper side of said hinged links (18), said first and second upper brackets being connected to said first pair (21*b*) of said two axis universal joints.

7. The yoke assembly of claim 6 wherein said first and second lower brackets 31(*b*) are placed on said hinged link (18) such that while said yoke assembly is in an at-rest neutral position, a line through a center of gravity (39) of said stiff member (38) and a center of said first and second upper brackets (31(*a*)) passes through a center of said first and second lower brackets 31(*b*), wherein said yoke assembly is characterized by approximately equal force stiffness in the aft direction and in the forward direction from at-rest neutral position.

8. The yoke assembly of claim 6 wherein said first and second lower brackets (31(*b*)) are placed on said hinged link (18) while said yoke assembly is in an at-rest neutral position, forward of a line through a center of gravity (39) and a center of said first and second upper brackets (31(*a*)), wherein said yoke assembly (24) is characterized by more force stiffness in the aft direction than it does in the forward direction from at-rest neutral position.

9. A yoke assembly for mooring a vessel to a body comprising, a yoke (17) having a first end and a second end, with said first end arranged and designed for coupling with either said vessel or with said body and said second end arranged and designed for coupling with a frame (100) carried by said body or by said vessel, said second end having first and second side members (80) and a connection assembly (90) includes, a torsionally stiff weighted member (38) having a hinged link (18) at first and second ends, said hinged link having upper and lower sides, first and second hinges (25) coupling said lower side of said hinged links (18) of said stiff member at said first and second ends thereof to said first and second side members of said second end of said yoke, and first and second links (19) coupled to said frame and to said upper side of said hinged links (18) by first and second pairs (21*a*, 21*b*) of two axis universal joints, wherein said force stiffness of said first end of said yoke (17) is $$K_x = \frac{\Delta F_x}{\Delta X_1}, \text{ and}$$

$$K_y = \frac{\Delta F_y}{\Delta Y_1}$$

where ΔX and ΔY represent small displacement increments corresponding to small increments in forces Fx and Fy near any displacement x1 and y1, and said yoke assembly is characterized by the ratio $$\frac{K_y}{K_x} \geq 0.5,$$

whereby said connection assembly (90) is arranged and designed to provide fore-and-aft resistance to an x-direction force on said yoke (17) of less than twice the resistance of a y-direction force of the same magnitude on said first end of said yoke (17).

10. A yoke assembly for mooring a vessel to a body comprising, a yoke (17) having a first end and a second end, with said first end arranged and designed for coupling with either said vessel or with said body and said second end arranged and designed for coupling with a frame (100) carried by said body or by said vessel, said second end having first and second side members (80) and a connection assembly (90) including, a torsionally stiff weighted member (38) having a hinged link (18) at first and second ends, said hinged link having upper and lower sides, first and second hinges (25) coupling said lower side of said hinged links (18) of said stiff member at said first and second ends thereof to said first and second side members of said second end of said yoke, and first and second links (19) coupled to said frame and to said upper side of said hinged links (18) by first and second pairs (21*a*, 21*b*) of two axis universal joints, wherein said first end of said yoke (17) is arranged and designed for connection to a carrier vessel, and with said first end of said yoke (17) designed and arranged with said connection assembly (90) to rotate with respect to said body, and a buoyancy chamber (29) is disposed in said second end of said yoke, said buoyancy chamber (29) having sufficient buoyancy to cause said second end of said yoke to float when said yoke is disconnected from said carrier vessel.

11. An offshore off-loading system comprising, a storage station (1) for storing hydrocarbon products, a shuttle vessel (2) arranged and designed for transporting hydrocarbon products, a yoke assembly (24) including a yoke (17) with first and second ends and a connection assembly (90), said second end of said yoke and said connection assembly rotatably connected to said storage station (1) and a first end of said yoke (17) is selectively connectable to said shuttle vessel, said connection assembly (90) including a torsionally stiff weighted member (38) having a hinged link (18) at first and second ends, said hinged link having upper and lower sides, first and second hinges (25) coupling said lower side of said hinged links (18) of said stiff weighted member (38) at said first and second ends thereof to first and second side members (80) of said second end of said yoke, and first and second links (19) coupled to said frame (100) and to said first and second ends of said stiff member (38) of said upper side thereof by first and second pairs (21*a*, 21*b*) of two axis universal joints, wherein said force stiffness of said first end of said yoke (17) is $$K_x = \frac{\Delta F_x}{\Delta X_1}, \text{ and}$$

-continued $$K_y = \frac{\Delta F_y}{\Delta Y_1}$$

wherein ΔX and ΔY represent small displacement increments corresponding to small increments in force Fx and Fy near any displacement x1 and y1, and said yoke assembly is characterized by the ratio $$\frac{K_y}{K_x} \geq 0.5,$$

whereby a transfer force in the y-direction moves the first end of said yoke (17) less than or equal to twice the movement of said first end of said yoke (17) in response to an x-direction force of equal magnitude to the y-direction force.

* * * * *